US007168338B2

(12) United States Patent
Hopper, Jr. et al.

(10) Patent No.: US 7,168,338 B2
(45) Date of Patent: Jan. 30, 2007

(54) DEAD BLOW HAMMER WITH COMPOSITE HOLDER

(75) Inventors: Richard L. Hopper, Jr., Kenosha, WI (US); Thomas Whalen, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 10/998,428

(22) Filed: Nov. 29, 2004

(65) Prior Publication Data

US 2006/0112789 A1 Jun. 1, 2006

(51) Int. Cl.
*B25D 1/12* (2006.01)

(52) U.S. Cl. ..... 81/22; 81/25

(58) Field of Classification Search ..... 81/22, 81/25

See application file for complete search history.

(56) References Cited

U.S. PATENT DOCUMENTS

| | | | | |
|---|---|---|---|---|
| 3,088,506 | A | 5/1963 | Bianchini | |
| 3,343,576 | A | 9/1967 | Norcross | |
| 3,844,321 | A | 10/1974 | Cook | |
| 4,039,012 | A | 8/1977 | Cook | |
| 4,697,481 | A | 10/1987 | Maeda | |
| 4,831,901 | A * | 5/1989 | Kinne | 81/25 |
| 5,280,739 | A | 1/1994 | Liou | |
| 5,375,486 | A | 12/1994 | Carmien | |
| 5,408,902 | A | 4/1995 | Burnett | |
| 5,458,840 | A | 10/1995 | Carmien | |
| 5,537,896 | A | 7/1996 | Halder | |
| 5,657,674 | A | 8/1997 | Burnett | |
| 5,916,338 | A | 6/1999 | Bergkvist et al. | |
| 5,960,677 | A | 10/1999 | Carmien | |
| 6,052,885 | A | 4/2000 | Carmien | |
| 6,128,977 | A * | 10/2000 | Gierer et al. | 81/22 |
| 6,202,511 | B1 | 3/2001 | Murray et al. | |
| 6,227,075 | B1 * | 5/2001 | Carmien | 81/22 |
| 6,234,048 | B1 * | 5/2001 | Carmien | 81/22 |
| 6,467,376 | B1 | 10/2002 | Wu | |
| 6,595,087 | B2 | 7/2003 | Whalen et al. | |
| 6,640,447 | B2 | 11/2003 | Wickline | |

* cited by examiner

*Primary Examiner*—David B. Thomas
(74) *Attorney, Agent, or Firm*—Seyfarth Shaw LLP

(57) ABSTRACT

A composite hammer comprising a head having a periphery and a longitudinal axis, a collar disposed substantially about the periphery and having an inner surface and a neck tube projecting radially outwardly therefrom, the neck tube being inclined relative to the longitudinal axis, and a handle having a proximal working end received in the neck tube and a distal end.

29 Claims, 3 Drawing Sheets

DEAD BLOW HAMMER WITH COMPOSITE HOLDER

BACKGROUND OF THE INVENTION

This application relates generally to impact tools, such as hammers, and, more particularly, relates to hammers of the type designed to minimize rebound, commonly referred to as "dead blow hammers."

Dead blow hammers are typically provided with a head which is, at least, partially filled with a flowable, rebound-inhibiting material, such as steel pellets or shot. As such, the rebound-inhibiting material absorbs a majority of the impact force when the hammer impacts a work surface and prevents a rebound effect. However, many such hammers have handles which extend into the tubular hammer head, thus impeding the free-flowability of the rebound-inhibiting material.

It is known to provide dead blow hammers formed from a skeleton consisting of a hammer head and handle framework, partially or fully encapsulated or encased within an outer casing or covering which may be overmolded onto the skeleton. However, such prior encapsulated hammers have had complicated or require expensive skeletal structures and/or have been characterized by less than optimal weight distribution between the hammer head and the handle. Further, the hammer head and the handle are typically formed of the same material, thus providing a conduit for the transmission of vibrational forces during use.

U.S. Pat. No. 6,595,087, which is commonly assigned with the present application, optimizes the weight distribution between the hammer head and the handle and avoids penetration of the head with the handle by providing a radially, outwardly projecting neck tube integrally coupled to the hammer head, such as with a weldment, and adapted to receive a working end of the handle, which may be formed of any material. The hammer head and handle are then overmolded with a plastic material.

SUMMARY OF THE INVENTION

The present application discloses an improved dead blow hammer, and a method for making the same, having a skeleton consisting of a hammer head, a collar adapted to be disposed substantially about the hammer head, and a handle. The collar includes a neck tube outwardly radially extending therefrom which is adapted to receive a working end of the handle. In an embodiment, the assembled hammer, including the hammer head, the collar and the handle, is substantially encapsulated with a casing.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION

Figure 1:
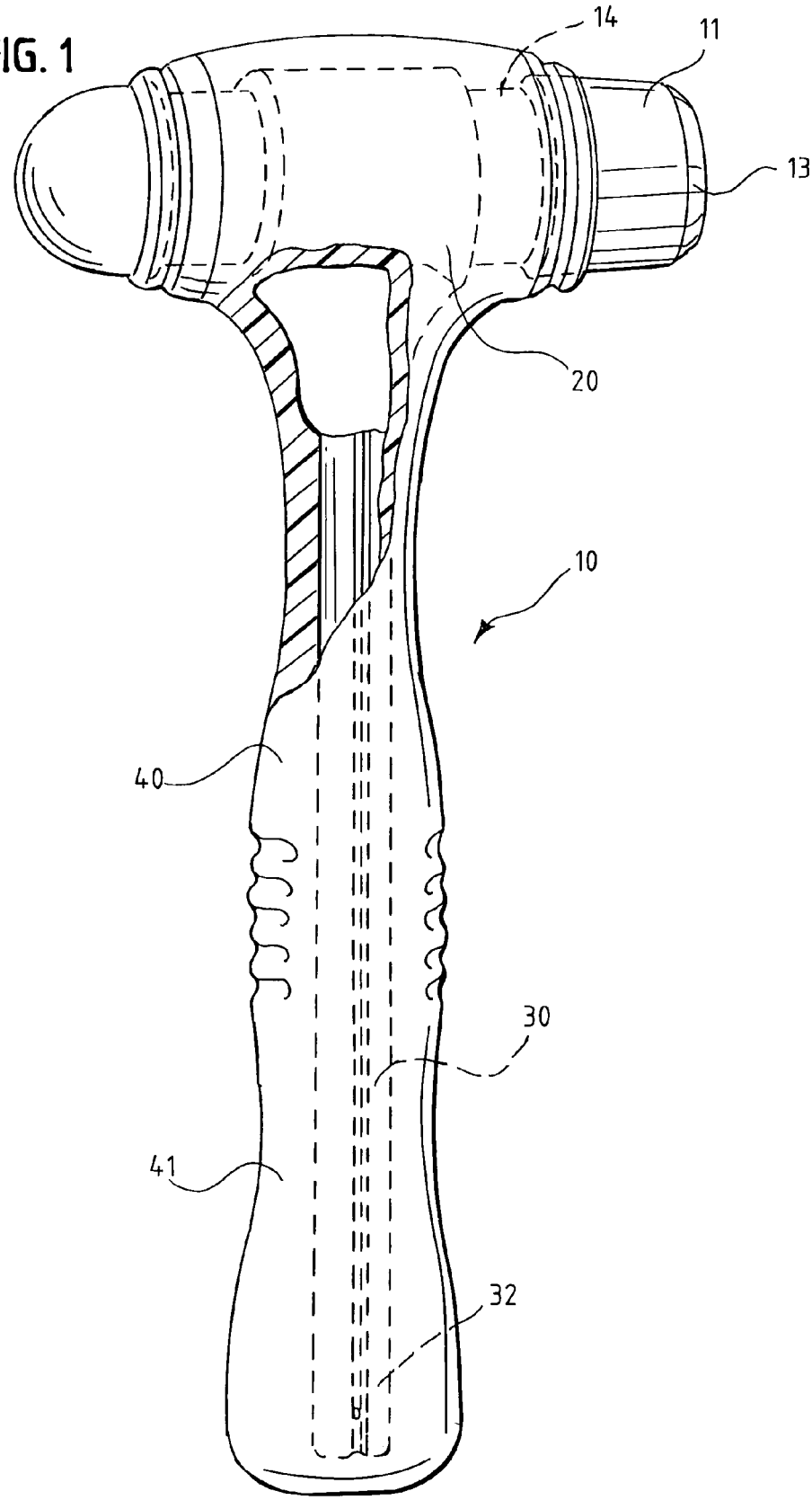
FIG. 1 is a perspective view of a hammer encapsulated within a casing, with a portion broken away.
Figure 2:
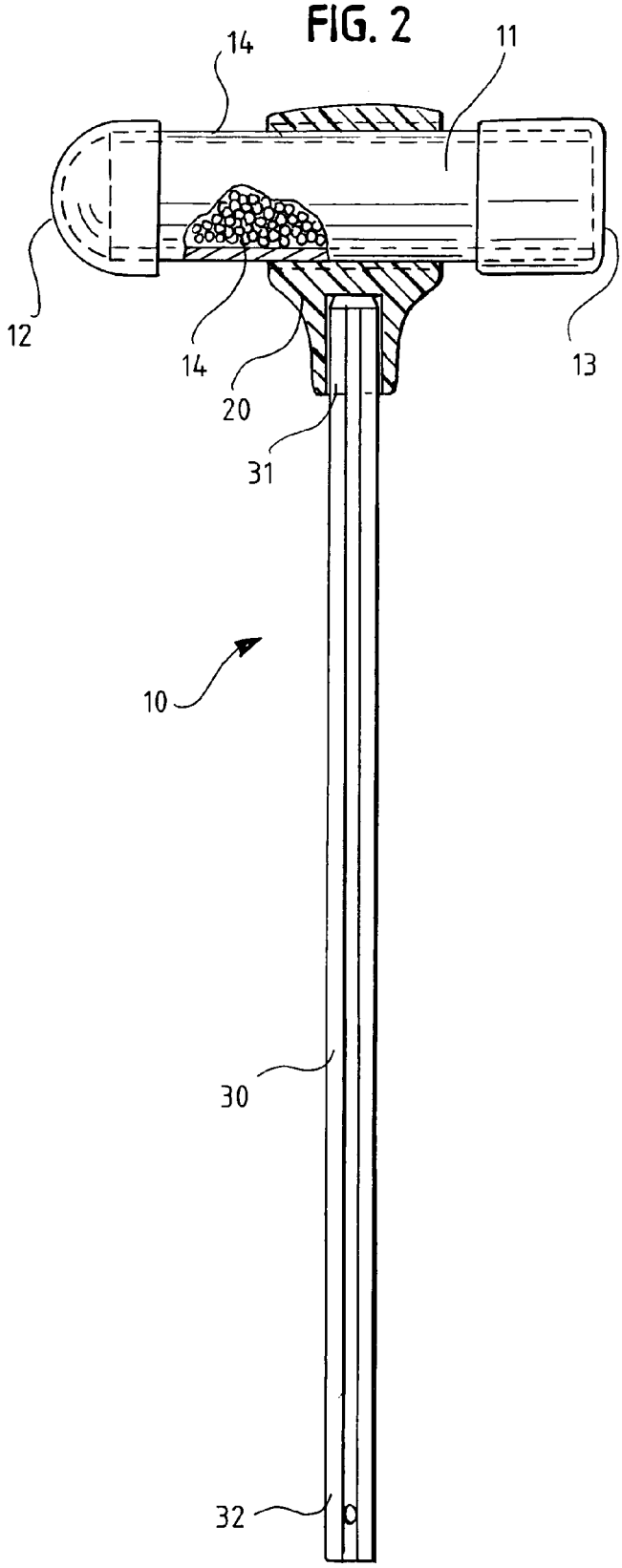
FIG. 2 is a reduced, side elevational view of the hammer of FIG. 1 shown removed from the casing, with a portion broken away.
Figure 3:
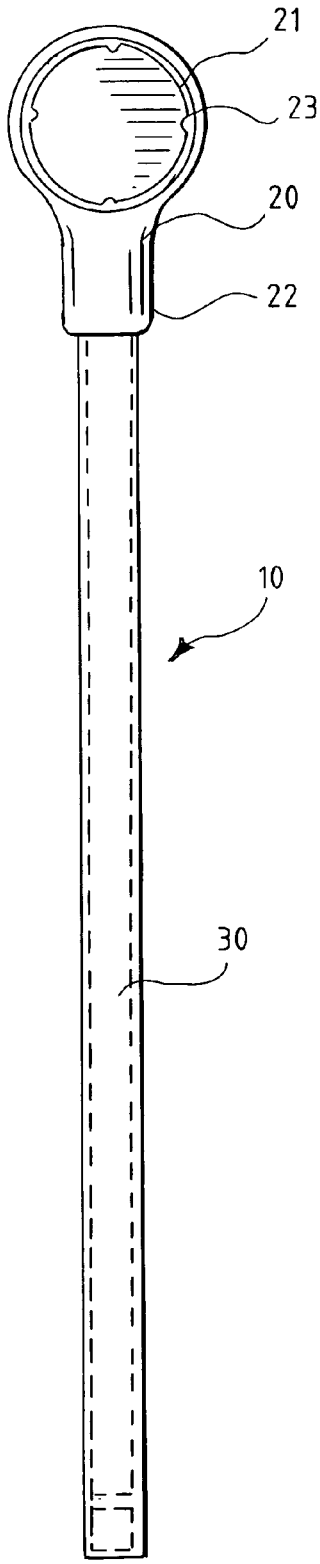
FIG. 3 is a front elevational view of the hammer of FIG. 2, shown with the hammer head removed.
Figure 4:
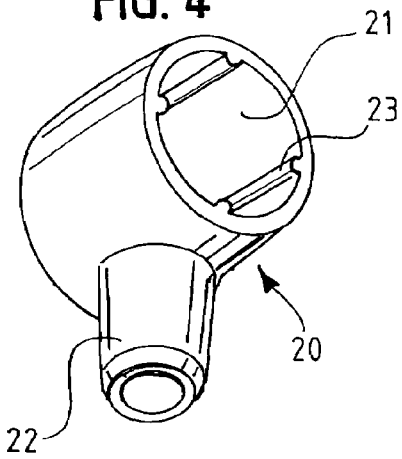
FIG. 4 is a perspective view of the collar of FIG. 3.
Figure 6:
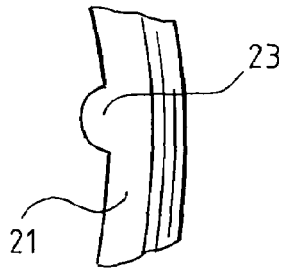
FIG. 6 is an enlarged, fragmentary view of the encircled portion of the collar of FIG. 5.
Figure 7:
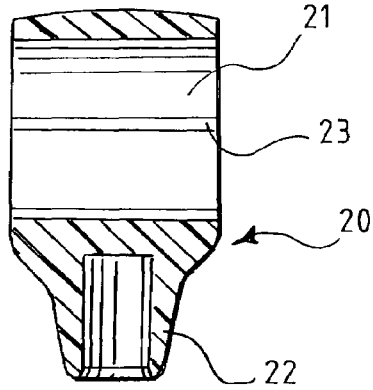
FIG. 7 is a side cross-sectional view taken generally along the line 7—7 of FIG. 5.
Figure 5:
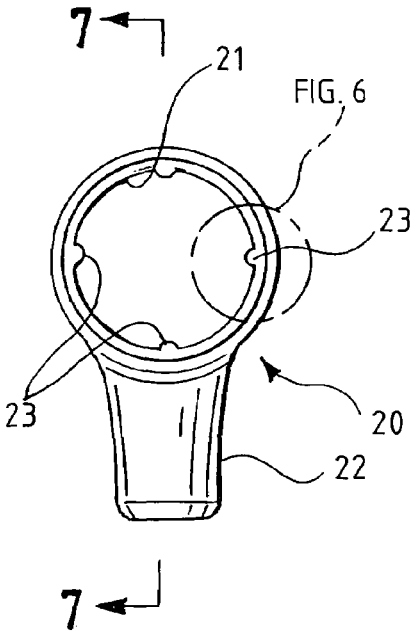
FIG. 5 is a front view of the collar of FIG. 4.
Figure 8:
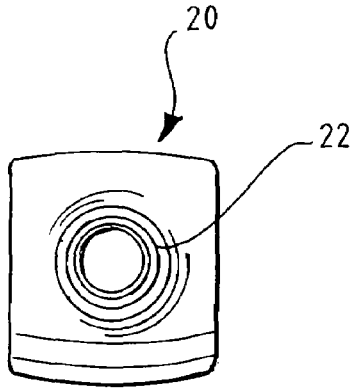
FIG. 8 is a bottom view of the collar of FIG. 5.

Referring to FIGS. 1–3, the present application discloses a composite hammer 10. In an embodiment, the hammer 10 is a dead blow hammer having a skeleton including a substantially tubular hammer head 11 having first and second ends 12, 13, that are adapted to be impacted against a work surface, and a periphery 14. In an embodiment, first and second ends 12, 13 are caps integrally coupled, such as, for example, with a friction fit, weldment or adhesion, to the periphery 14 respectively adjacent to the opposing ends of the tubular hammer head 11. The hammer head 11 may be filled with a substantially flowable, rebound-inhibiting material 14. In an embodiment, the hammer head 11 is substantially cylindrical. The substantially cylindrical shape of the hammer head defines a longitudinal axis. In an embodiment, first end 12 is substantially rounded or conical and second end 13 is substantially flat. In an embodiment, the rebound-inhibiting material includes a plurality of rigid pellets. In an embodiment, the pellets are steel shot.

In an embodiment, the hammer includes a collar 20 disposed substantially about the periphery 14 and intermediately on the hammer head 11, and a handle 30 having a working end 31 and a distal end 32. The hammer head 11, the collar 20 and the handle 30, when in an assembled condition, may be substantially overmolded or encapsulated with a casing 40. The casing 40 may be formed of an elastomeric material. Casing 40 may include an overmolded or formed resilient grip 41 disposed adjacently to the distal end 32.

In an embodiment, the handle 30 is formed of a fibrous material, such as, for example, fiberglass or carbon fiber.

Referring also to FIGS. 4–8, in an embodiment, the collar 20 may be substantially cylindrical and includes an inner surface 21. In an embodiment, the collar 20 includes a radially outwardly extending, substantially tubular neck tube 22 that is adapted to receive the working end 31 of the handle 30. In an embodiment, the inner diameter of the neck tube 22 is substantially the same as the outer diameter of the working end 31 of the handle 30. In an another embodiment, the inner diameter of the neck tube 22 is slightly less than the outer diameter of the working end 31 of the handle 30, so that when in an assembled condition, the neck tube 22 and the working end 31 of the handle 30 form a press-fit connection. In yet another embodiment, the working end 31 of the handle 30 may be adhesively secured within the neck tube 22.

When the hammer 10 is in an assembled condition, the neck tube 22 is inclined relative to the longitudinal axis. In an embodiment, the neck tube 22 is substantially perpendicular to the longitudinal axis.

In an embodiment, the inner surface 21 of the collar 20 is adapted to form a friction-fit with the periphery 14 of the hammer head 11 when the collar 20 is disposed substantially about the periphery 14 and intermediately on the hammer head 11. The inner surface 21 may include a plurality of inwardly extending ribs 23 that are substantially parallel to the longitudinal axis and are adapted to frictionally engage the periphery 14 when the hammer 10 is in an assembled condition. The ribs 23 may be circumferentially disposed about the inner surface 21 and be substantially equiangularly spaced relative to each other.

Also disclosed herein is a method of making a hammer. The method comprises providing a substantially tubular head having a periphery and a longitudinal axis, frictionally fitting a collar having an inner surface and a neck tube radially outwardly projecting therefrom with the head so that the collar is substantially intermediately disposed on the head and the neck tube is inclined relative to the longitudinal axis, inserting a proximal, working end of a handle in the neck tube, and substantially encapsulating the head, the collar and the handle with an elastomeric casing. The method may further comprise adhesively securing the handle to the neck tube. The method may also comprise overmolding a grip on the casing adjacent to a distal end of the handle or filling the head with a substantially flowable, rebound-inhibiting material.

From the foregoing, it can be seen that there has been described an improved dead blow hammer which is of simple and economical construction, improved weight distribution and force-delivering capacity, and improved vibration resistance and ergonomic design.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A composite hammer comprising:

a head having a periphery and a longitudinal axis;

a collar disposed substantially about the periphery and having an inner surface and a neck tube projecting radially outwardly therefrom, the neck tube being inclined relative to the longitudinal axis; and a handle having a working end received in the neck tube and a distal end, wherein the inner surface and the periphery form a friction fit therebetween.

2. The hammer as claimed in claim 1 wherein the collar is substantially cylindrical.

3. The hammer as claimed in claim 1 wherein the head is tubular.

4. The hammer as claimed in claim 3 wherein the head contains a substantially flowable, rebound-inhibiting material.

5. The hammer as claimed in claim 4 wherein the material includes a plurality of rigid pellets.

6. The hammer as claimed in claim 1 wherein the handle is formed of a fibrous material.

7. The hammer as claimed in claim 6 wherein the fibrous material is fiberglass.

8. The hammer as claimed in claim 1 further comprising a casing substantially encapsulating the head, the collar and the handle.

9. The hammer as claimed in claim 8 wherein the casing is formed of an elastomeric material.

10. The hammer as claimed in claim 9 wherein the casing includes a resilient grip disposed adjacent to the distal end of the handle.

11. The hammer as claimed in claim 1 wherein the inner surface includes a plurality of radially inwardly projecting ribs.

12. The hammer as claimed in claim 11 wherein the ribs are substantially equiangularly spaced relative to each other.

13. The hammer as claimed in claim 1 wherein the working end of the handle is adhesively secured to the neck tube.

14. An apparatus for coupling a handle to a substantially cylindrical hammer head, comprising a collar for disposition substantially about the hammer head and having an inner surface and a neck tube projecting radially outwardly therefrom for receiving an end of the handle, wherein the inner surface includes a plurality of radially inwardly projecting ribs.

15. The apparatus as claimed in claim 14 wherein the collar is substantially cylindrical.

16. The apparatus as claimed in claim 14 wherein the ribs are substantially equiangularly spaced relative to each other.

17. The hammer as claimed in claim 16 wherein the handle is formed of a fibrous material.

18. A hammer comprising:

a tubular head having a periphery and a longitudinal axis;

a collar disposed substantially about the periphery and having an inner surface with a plurality of substantially equiangularly spaced, radially inwardly projecting ribs and a neck tube radially outwardly projecting therefrom, the neck tube being inclined relative to the longitudinal axis;

a handle having a working end received in the neck tube and a distal end; and an elastomeric casing substantially encapsulating the head, the collar and the handle, the casing including a resilient grip disposed adjacent to the distal end of the handle.

19. The hammer as claimed in claim 18 wherein the collar is substantially cylindrical.

20. The hammer as claimed in claim 18 wherein the head is substantially tubular.

21. The hammer as claimed in claim 20 wherein the head contains a substantially flowable, rebound-inhibiting material.

22. The hammer as claimed in claim 21 wherein the material includes a plurality of rigid pellets.

23. A method of making a hammer, comprising:

providing a tubular head having a periphery and a longitudinal axis;

frictionally fitting a collar having an inner surface and a neck tube radially outwardly projecting therefrom with the head so that the collar is substantially intermediately disposed on the head and the neck tube is inclined relative to the longitudinal axis;

inserting a proximal end of a handle in the neck tube; and substantially encapsulating the head, the collar and the handle with an elastomeric casing.

24. The method as claimed in claim 23 further comprising adhesively securing the handle to the neck tube.

25. The method as claimed in claim 23 further comprising overmolding a grip on the casing adjacent to a distal end of the handle.

26. The method as claimed in claim 23 further comprising filling the head with a substantially flowable, rebound-inhibiting material.

27. A hammer comprising:

a hammer head having a periphery and a longitudinal axis; and a means for coupling a handle to the hammer head; and an elastomeric casing substantially encapsulating the hammer head, the means for coupling and the handle, the casing including a resilient grip disposed adjacent to the distal end of the handle.

28. The hammer as claimed in claim 27 wherein the means for coupling a handle to the hammer head includes a collar disposed substantially about the periphery having a neck tube radially outwardly projecting therefrom for receiving a working end of the handle, the neck tube being inclined relative to the longitudinal axis.

29. The hammer as claimed in claim 28 wherein the neck tube includes an inner surface having a plurality of substantially equiangularly spaced, radially inwardly projecting ribs.

* * * * *